US005209673A

United States Patent [19]

Mohn et al.

[11] Patent Number: 5,209,673

[45] Date of Patent: May 11, 1993

[54] SUBSEA ELECTRICAL CONDUCTIVE INSERT COUPLING

[75] Inventors: Frank Mohn, Fjosanger; Bjorn G. Bjornsen, Sandnes, both of Norway

[73] Assignee: Framo Developments (UK) Limited, London, England

[21] Appl. No.: 721,626

[22] PCT Filed: Jan. 18, 1990

[86] PCT No.: PCT/GB90/00082

§ 371 Date: Sep. 13, 1991

§ 102(e) Date: Sep. 13, 1991

[87] PCT Pub. No.: WO90/08406

PCT Pub. Date: Jul. 26, 1990

[30] Foreign Application Priority Data

Jan. 18, 1989 [GB] United Kingdom ..... 8901096

[51] Int. Cl.[5] ..... H01R 4/60

[52] U.S. Cl. ..... 439/199; 439/668; 439/191; 166/65.1

[58] Field of Search ..... 166/65.1, 66.4; 439/190, 191, 199, 201, 205, 140, 141, 668

[56] References Cited

U.S. PATENT DOCUMENTS 3,946,805 3/1976 Peterman .
4,080,025 3/1978 Garnier et al. .
4,188,084 2/1980 Buresi et al. .
4,304,452 12/1981 Kiefer ..... 439/199
4,544,036 10/1985 Saliger .
4,625,805 12/1986 Ladecky .
4,767,349 8/1988 Pottier et al. ..... 439/191
4,781,607 11/1988 Rumbaugh ..... 439/191
4,806,114 2/1989 Hopper ..... 439/191
4,899,822 2/1990 Daeschler et al. ..... 439/191 X

FOREIGN PATENT DOCUMENTS 739684 11/1955 United Kingdom .
2113484 8/1983 United Kingdom ..... 439/190

*Primary Examiner*—Larry I. Schwartz
*Assistant Examiner*—Khiem Nguyen
*Attorney, Agent, or Firm*—Young & Thompson

[57] ABSTRACT

Apparatus for coupling a subsea module to an umbilical termination head from a subsea installation which comprises a receiver (14) mounted on the module, a receiver (15) mounted on the umbilical, and a conductive insert coupling (CIC) (13). The receivers (13, 14) each have electrical terminal sets (24, 25). The CIC (13) has a pair of spaced electrical terminal sets (22, 23) in which respective terminals in each set are electrically connected by concentric conductive tubes. The receivers (14, 15) are arranged to receive the CIC (13) so that when it is in position in the receivers (14, 15), each of the CIC terminal sets (22, 23) contacts one of the receiver terminal sets (24, 25) thereby forming an electrical connection between the two receiver terminal sets (24, 25).

24 Claims, 11 Drawing Sheets

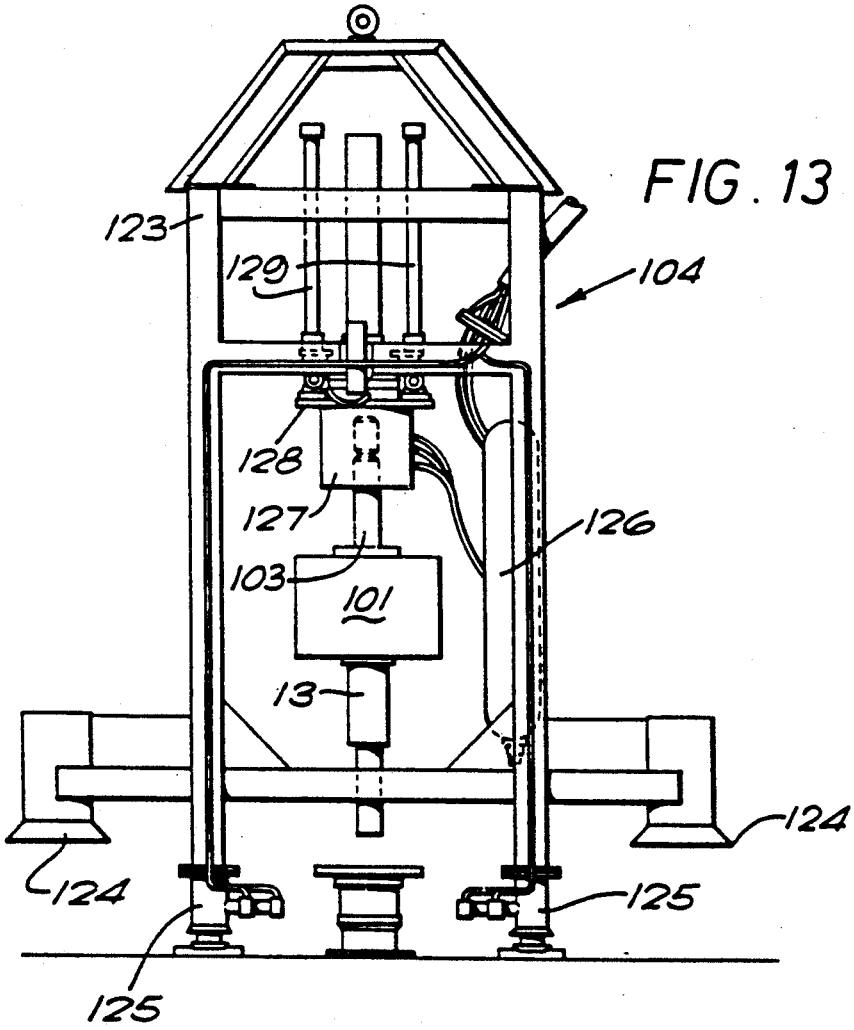
FIG. 13
FIG. 14
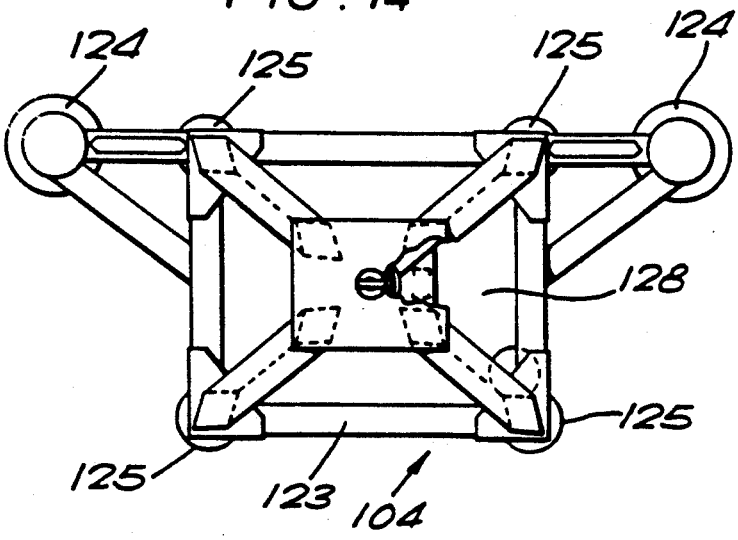

SUBSEA ELECTRICAL CONDUCTIVE INSERT COUPLING

FIELD OF THE INVENTION

The present invention relates to a subsea electrical conductive insert coupler (CIC) for coupling a subsea module to an umbilical termination head or lower module from an installation located on the sea bed. The module may be a pumping station or some other equipment requiring a high power supply and optionally hydraulic and signals connections.

OBJECTS OF THE INVENTION

It is an object of the present invention to provide an undersea coupling system for a subsea module and an umbilical which is reliable and which will ensure a long operating life.

It is a further object of the invention to provide such a system which provides for speed and ease of installation and retrieval.

It is a further object of the invention to provide a coupling designed to conduct 1 MW or more of power which is also capable of eliminating the ingress of water during installation and operation.

It is a still further object of the invention to provide such a coupling system in which the components left undersea are passive, all active components being retrievable.

SUMMARY OF THE INVENTION

According to one aspect of the invention there is provided an apparatus for coupling a subsea module to an umbilical termination head from a subsea installation, comprising: a receiver mounted on the module; a receiver mounted on the umbilical; and an insert stab mandrel (ISM); the receivers each having electrical terminal sets; the ISM having a pair of spaced electrical terminal sets in which respective terminals in each set are electrically connected; the receivers being arranged to receive the ISM so that when it is in position in the receivers, each of the ISM terminal sets contacts one of the receiver terminal sets, thereby forming an electrical connection between the two receiver terminal sets.

The invention also extends to a method of performing such a coupling operation which entails inserting such an ISM into such a pair of receivers.

Preferably, the umbilical receiver includes a hydraulic fluid outlet, the module receiver includes a hydraulic fluid inlet and the ISM includes a supply hydraulic fluid inlet and the ISM includes a supply hydraulic fluid pathway interconnecting the said outlet and inlet. Preferably, the umbilical receiver includes a signals outlet, the module receiver includes a signals inlet and the ISM includes a signals pathway interconnecting the said outlet and inlet.

Preferably, the two receivers are located one above the other in use and ISM is arranged to extend through the upper receiver and into the lower receiver. Preferably, the upper receiver is the module receiver. Optionally, the receivers are spaced apart vertically and each is mounted to allow limited pivotal movement. More preferably, the upper receiver is received within the lower receiver, the upper receiver being non-rigidly mounted.

Preferably, the electrical terminals are a pair of contact areas on the ISM, each comprising electrical contact bands located in grooves, and a corresponding contact area within each receiver. Preferably, the contact areas bands in each receiver are covered by a respective sliding sleeve before connection which is displaced upon insertion of the ISM. Conveniently, the sliding sleeves are urged by spring means to the positions in which the contact bands are covered and the contact bands on the ISM are covered by a pair of sliding sleeves before connection which are displaced upon insertion of the ISM.

Preferably the ISM includes a self contained oil flushing system arranged to supply oil to the contact areas upon insertion and withdrawal of the ISM. Thus, during normal operation, the coupling conductive contact bands may be continuously flushed with oil, by an integral stand-alone circulation system for preventing water ingress and to provide cooling of the conductive bands.

The apparatus may be run subsea using a cable or drill pipe and may use guide lines and guide posts for primary alignment. The coupling operation may be effected by direct hydraulic surface control.

Such a coupling system is capable of conducting 1 MW of power (e.g. max. current 100 A, max voltage 1000 V, 3 phase, 50/60 Hz) from the umbilical to the module. The system may show many advantages. The connection is simple and can be carried out in a single trip, and the ISM can be installed and retrieved with the module in place. Also, the ISM can be pulled or sheared out in an emergency situation, it can be removed independently of the subsea module, it has no internal stroking hydraulic systems, its coupling requires no internal flexibility and is constructed without any moving parts, and it can be retrieved by pulling the subsea module.

Furthermore, as will have been appreciated, when the ISM is pulled, the receivers' sliding sleeve assemblies will move up and protect the contact ring area, and the concept allows for a constant flow of cleaning/coolant hydraulic oil across the contact areas. In the event of a problem, the outboard receiver contact area in the umbilical termination head can be machined or honed subsea and the ISM can be altered to match if required.

Preferably, both the subsea module and the umbilical termination head will be connected by means of the systems guide base. Although, each element will be aligned to the guidebase there will inevitably be a positional and angular misalignment from the nominal theoretical position. The coupling is able to accommodate this mismatch. For the purposes of designing the coupler, the following positional and rotational misalignments have been considered to be realistic:

Positional misalignment in x, y, z plane = +/−10 mm

Rotational misalignment in Rx, Ry, Rz, = +/−2 deg

In its broadest sense, the invention is a conductive insert coupler (CIC) system which may be considered to lie in two female receivers, one mounted on the umbilical termination head and one mounted on the subsea module which is positioned concentrically over the lower out-board receiver. The connection between the two receivers is achieved by stabbing a rigid mandrel (Insert Stab Mandrel—ISM) through both receivers and the power is conveyed from conductive rings in the lower female receiver through the ISM and out via the upper female receiver conductive rings into the subsea module. The conductive ring area in both receivers may then be protected by an elastomeric seal assembly and during normal operation, hydraulic fluid is pumped through the system and across the conductive rings for temperature and particle build up control. To eliminate misalignment problems, each receiver sleeve may be set in a partial ball joint. By using this method, each receiver can move independently and assume a concentric position with the ISM and the other receiver. Thus, the ISM would align the two receivers.

In a preferred embodiment, the upper receiver stabs into the lower receiver as the subsea module is landed and locked down to the guidebase. This method simplifies the entry of the ISM and reduces induced loads on the insert coupler and system components. It also gives accurate positioning of the ISM handling head, as the final position of the lower receiver is known. In the first alternative, the final position of the handling head axis could be anywhere in a relatively large diameter, and the running tool would have to accommodate this misalignment.

In a preferred system, the connection of the upper and lower receivers is achieved using a fixed lower receiver and a floating upper receiver. During running of the subsea module the upper receiver is preferably held in a nominal position using a spring and a 45 degree shoulder in the support housing. The connection between the two receivers is preferably designed such that the upper receiver will always be pushed off the shoulder and held in space by the forces induced by a large compression spring or springs. The upper support housing is dimensioned such that there will be sufficient clearance to allow the upper receiver to move into the concentric axis of the lower receiver regardless of the relative misalignment of the subsea module and the umbilical termination head.

This embodiment therefore has the advantages that concentric alignment of the receiver bores is achieved prior to insertion of the ISM, thereby minimising the load induced during installation make-up; as the lower receiver in the umbilical termination head is the fixed system reference point, the problem of guidance and positioning of the ISM during installation is greatly simplified.

The primary purpose of the CIC system is to provide contact between an electrical power supply cable and a module requiring the electric power. The 3-phase electric power supply cable terminates in the three lower receiver conductor rings. The electric power is preferably then transmitted to the ISM lower conductor rings by means of flexible contact bands. Three concentric tubes in the ISM connecting the lower and upper sets of conductor rings may provide electrical contact between the bands. Contact between the ISM upper conductor rings and the upper receiver conductor rings may be provided by means of the same kind of flexible contact bands. The upper receiver conductor rings will be connected to the user supply cable.

To enable the Conductive Insert Coupler system (CIC) to be a self contained system, some subsystems may be integrated in the proposed CIC design. By integrating these systems, the only interface with a subsea module will be the transmission of power via a three-phase electrical line and the supply of hydraulic fluid. These integrated systems are: system status monitoring equipment; oil circulation system; hydraulic indexing device.

The functional requirement of the system status monitoring equipment would be to monitor and give system data from the operational condition of the CIC. Typically, the following conditions can be monitored: contact band temperature (and resistance); flushing pressure and filter condition; system leakage; index system function.

There are generally three methods by which the transmission of data may be achieved without the use of a dedicated signal line. These are: acoustic status monitoring; analog signal transmission on power lines; ROV observation status monitoring.

Acoustic status monitoring equipment can give data to a surface vessel above the installation which will activate the monitoring system and disengage after transmission. The system will need its own battery which can be recharged by the umbilical power supply. Data will have to be generated from dedicated transducers and converted into acoustic signals.

By transferring signals back along the power cable, the monitoring would be similar to the acoustic system. However, in this case, the data would be transmitted as analog signals and monitored continuously on the surface control facility.

The third method of monitoring the CIC status could be to deploy an inspection ROV reading off CIC mounted indicators. In the circulation system, sensors for pressure, temperature, and oil level can be installed, which can be inspected by a ROV. This monitoring is very simply, self-contained solution and does not require any electric power, signal transformation or signal transmission system.

It is likely that this ROV based system would be selected due to low cost and simplicity.

The circulation system for the Conductive Insert Coupler (CIC) is primarily installed to remove any debris or scaling from the coupler during operation, and to keep an over-pressure in the coupler to avoid seawater intrusion. A secondary effect will be cooling of the contact areas.

The circulation system may be mounted in a sealed reservoir, which together with a running/re-entry hub, may be mounted on the top flange of the CIC insert body. A balance piston may provide pressure equalisation between the seawater and the oil reservoir to prevent seawater ingress and make sure that the hydraulic system always will be balanced to the ambient pressure.

The hydraulic circulation pump will preferably provide a positive pressure difference between the sea and CIC contact areas and thus eliminate seawater ingress.

Electric power supply to the circulation system motor may be taken from the electric power being transferred through the mandrel and connected through the CIC insert body top flange. The electric power lines to the motor are preferably led through a stop switch installed on the balance piston. This arrangement will stop the electric motor if the reservoir oil level becomes lower than the pre-set value.

During installation of the CIC, the running tool hydraulic interface may be connected to the running/re-entry hub mounted on top of the circulation unit, where preferably, a spring return sliding sleeve will protect the hydraulic inlets in the hub. The hydraulic flushing lines from the running tool flushing system may be routed via the running/re-entry hub through the circulation system supply/return lines which would match with the hydraulic connections in the CIC body.

The function of an indexing system for the conductive insert coupler would be to move the ISM relative to the receivers remotely after a prolonged period of service. By twisting the ISM in the receivers, new contact points would be formed between the male and female connectors, thereby upgrading the conductive efficiency.

According to another aspect of the present invention, there is provided a conductive insert coupler (CIC) for connecting a subsea module to an umbilical termination head from a subsea installation, the CIC including an insert stab mandrel comprising an upper body portion, an intermediate body portion and a lower body portion, a first set of electrical contact bands located between the upper and intermediate body portions, a second set of electrical contact bands located between the intermediate and lower body portions, and a series of concentric conductors electrically connecting respective bands in the two sets.

Preferably, the components are held in compression by an axially extending tensioning rod. The CIC may also include a supply lubrication fluid passageway connecting an inlet to an outlet. The CIC may further include a flushing oil circulation system housing in a housing to which the mandrel is attached, the mandrel having flushing oil passageways to direct oil to the region of the conductors. It may also include a handling head by means of which the CIC can be transported by a running tool.

BRIEF DESCRIPTION OF THE DRAWINGS

The invention may be carried into practice in various ways and some embodiments will now be described by way of example with reference to the accompanying drawings, in which:

FIG. 13 is an elevation of a running tool for use with the present invention;

FIG. 14 is a plan view of the running tool of FIG. 13;

DETAILED DESCRIPTION OF THE INVENTION

Figure 1:
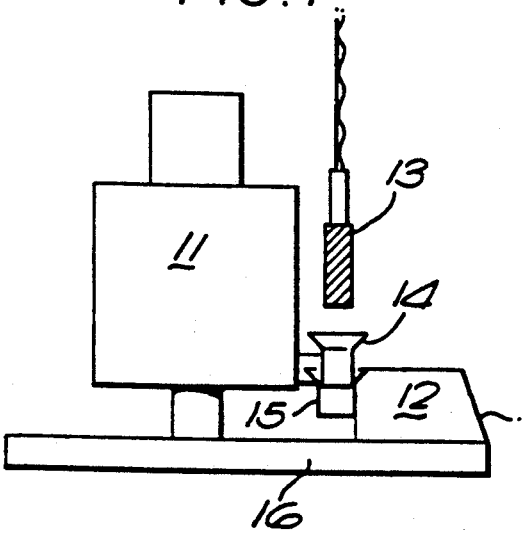
FIGS. 1 and 2 are schematic views showing sequential stages in the coupling of a subsea module to a dedicated umbilical in accordance with the invention.
Figure 2:
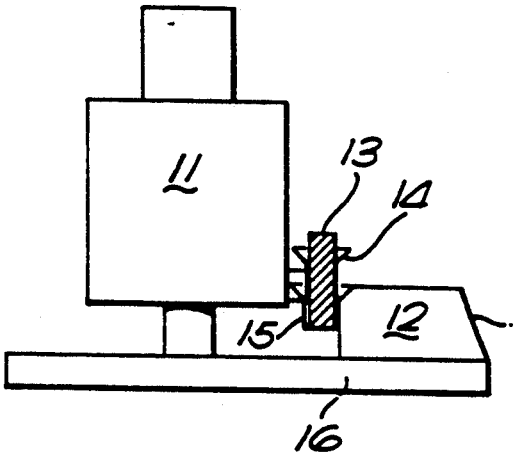

FIGS. 1 and 2 show schematically one system for coupling a subsea module 11 to an umbilical terminal head 12 extending from an under sea installation, such as a drilling basement, using an insert stab mandrel 13. The module 11 has an upper receiver 14 while the umbilical 12 has a lower receiver 15. The umbilical terminal head 12 is located on a guide base 16 which also serves to position the module 11; in this way the receivers are aligned so that the lower receiver 15 receives the upper receiver 14. In order to effect connection between the module 11 and the umbilical terminal head 12, the mandrel 13 is inserted into the receivers 14, 15. The mandrel 13 includes electrical and hydraulic and optionally signal connectors, as will be described in more detail below.

Figure 3:
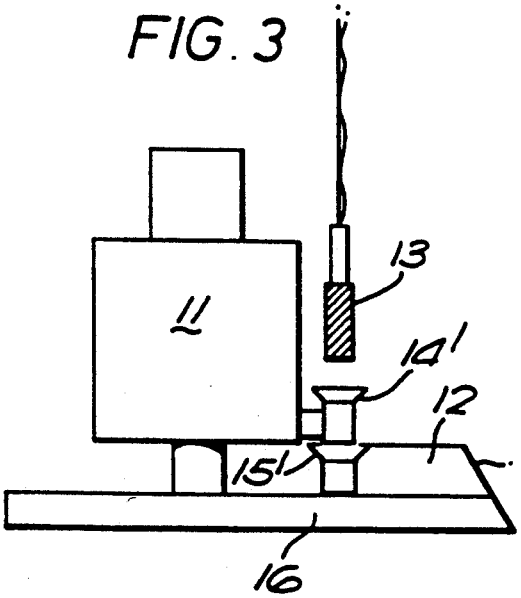
FIGS. 3 and 4 are similar to FIGS. 1 and 2 but show an alternative embodiment.
Figure 4:
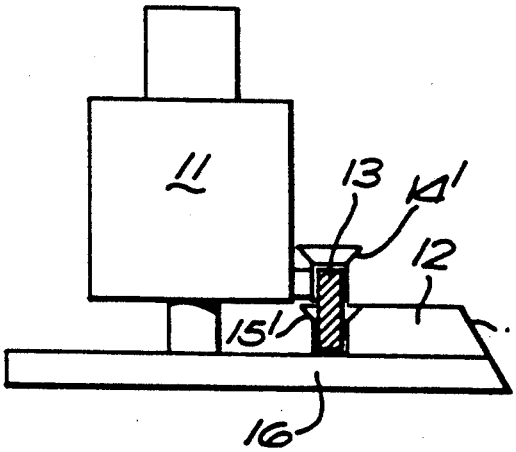

The embodiment shown in FIGS. 3 and 4 is similar to the previous embodiment. However, while the two receivers 14' and 15' are generally aligned in the same way, the lower receiver 15 does not receive the upper receiver 14'. Instead, final alignment is effected by the mandrel 13 itself as it connects the two receivers 14, 15 together.

Figure 5:
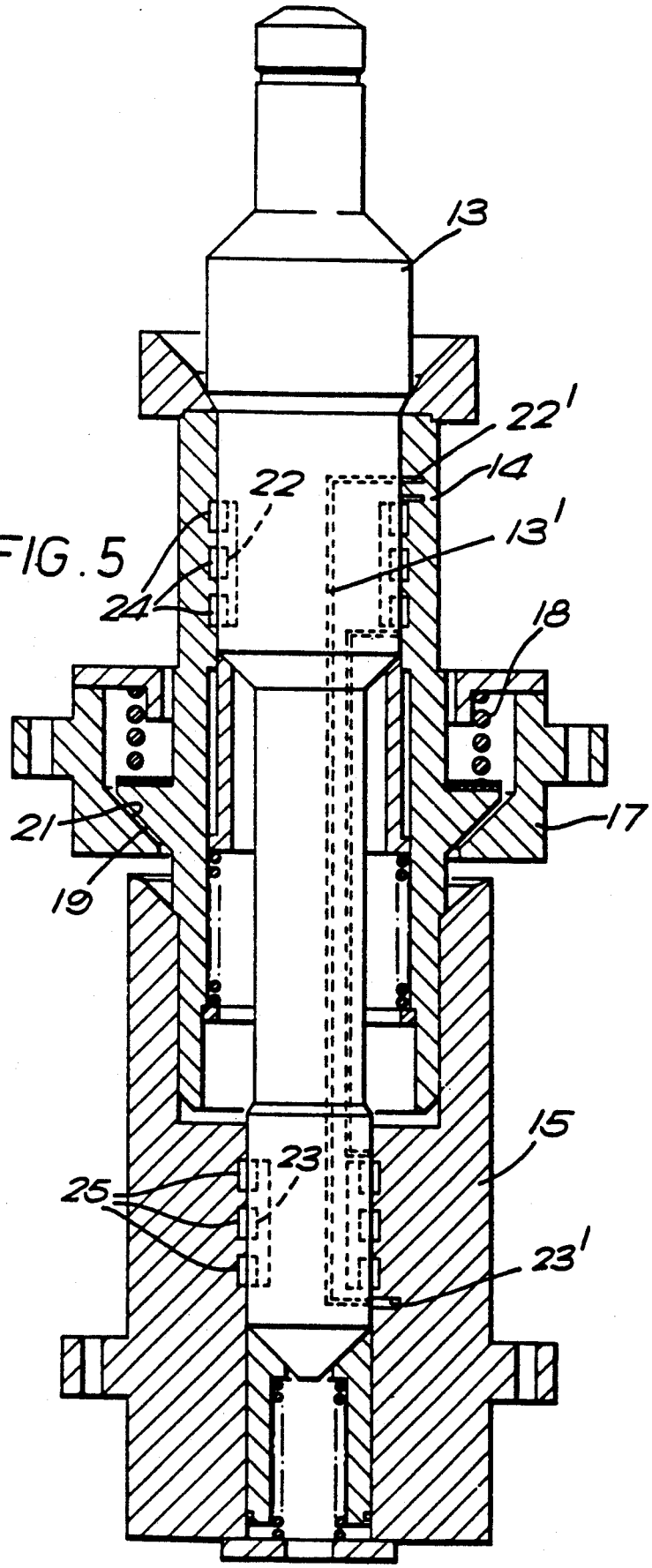
FIG. 5 is a simplified axial section through one embodiment of a connection system in accordance with the invention, in the coupled condition.

FIG. 5 shows in more detail a coupling system of the type illustrated schematically in FIGS. 1 and 2. The lower receiver 15 is fixedly mounted on the umbilical termination head (not shown). The upper receiver 14 is mounted on the module (not shown) through a mounting ring 17. It is a "floating" receiver in that it is not fixed rigidly to the ring 17; it is held in a nominal position by means of springs 18 and by the interaction of engagement shoulders 19, 21, inclined at 45°, on the receiver 14 and the ring 17.

As the module is landed and aligned by means of the guidebase, the upper receiver 14 is lifted relative to the ring 17 against the force of the springs 18 and the shoulders 19 and 21 disengage. Thus, small misalignments can be accommodated.

When the receivers 14, 15 are properly positioned, the mandrel 13 is lowered until it enters the receivers 14, 15. As it does so, electrical contact bands 22, 23 come into contact with corresponding bands 24, 25 in the receivers, thereby allowing electrical contact to be made between the module and the umbilical. A signals inlet 23' in the receiver 15 is connected to a signals outlet 22' in the receiver 14 by a signals pathway 13' in the mandrel 13. The structure of the components and their interaction will be described in more detail below in relation to FIGS. 8 to 11.

Figure 6:
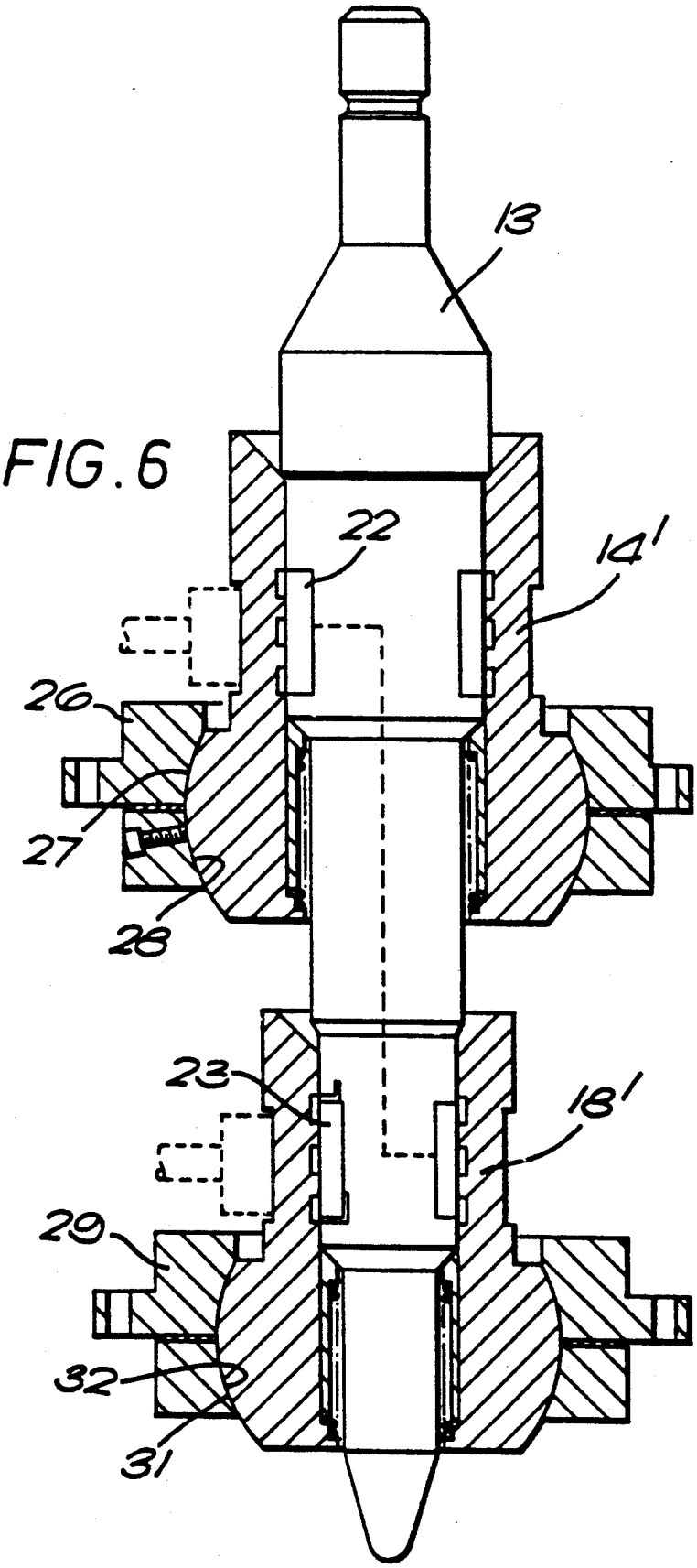
FIG. 6 is a view similar to FIG. 5 showing another embodiment.

FIG. 6 is a view similar to FIG. 5 but show a system of the type illustrated schematically in FIGS. 3 and 4. In this case the upper receiver 14' is mounted in a mounting ring 26 on the module (not shown) through part-spherical bearing contact surfaces 27, 28. The lower receiver 15' is similarly mounted in a mounting ring 29 through part-spherical bearing contact surfaces 31, 32. In this way, slight misalignments between the two receivers 14', 15' can be accommodated by the relative tilting allowed by the part-spherical surfaces 27, 28, 31, 32 as the mandrel 13 is inserted.

Figure 7:
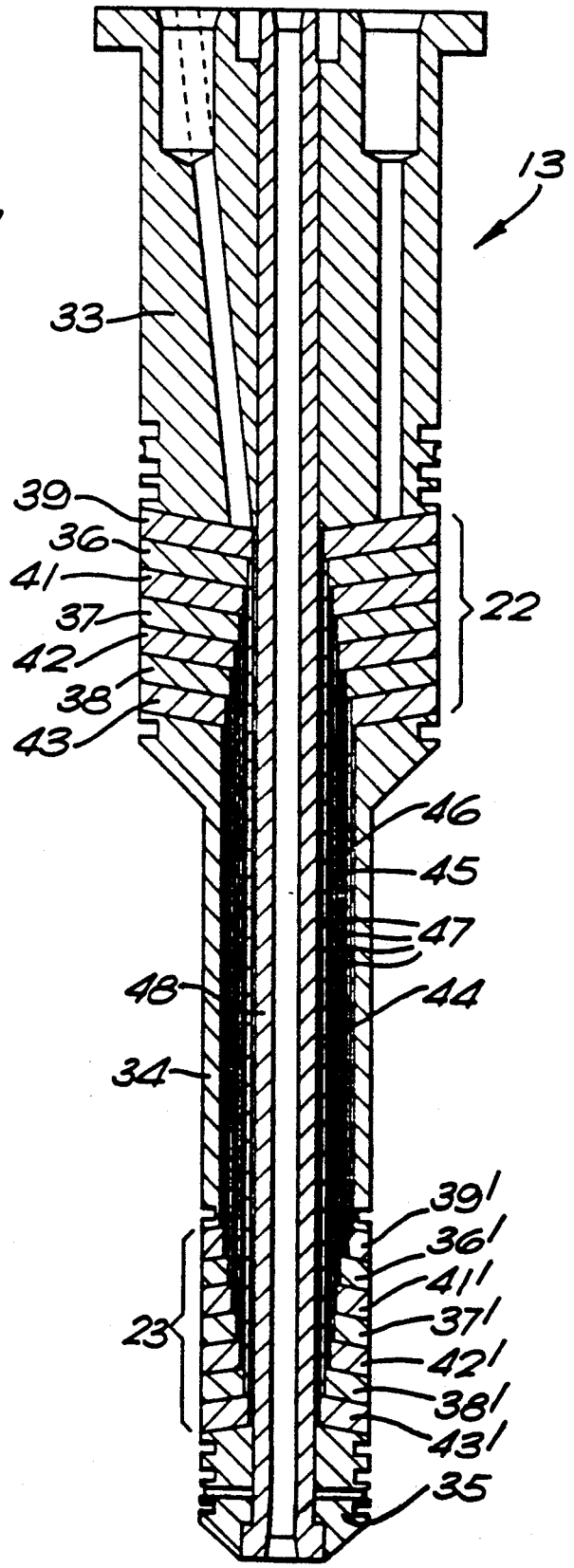
FIG. 7 is an axial cross section through a conductive insert coupler in accordance with the invention.

The mandrel 13 is shown in detail in FIG. 7. It comprises an upper body 33, an intermediate body 34 and a lower body 35. These bodies 33, 34, 35 are respectively separated by the electrical contact bands 22 and 23.

Each band e.g. 22 is made up of the three nickel conductor rings 36, 37, 38 (for the three-phase power to be handled) and four alternately arranged insulator rings 39, 41, 42, 43 made of a plastics insulating material. The equivalent components in the lower band 23 have the same reference numerals but with a prime added i.e. 36', 37' . . . etc. Corresponding conductor rings 36/36', 37/37' and 38/38' are connected together by means of concentric copper conducting tubes 44, 55, 46 respectively, which are themselves separated by layers of insulation 47. These tubes 44 to 47 are located within the intermediate body 34. The entire assembly is held in compression by a central axial tensioning rod or bolt 48.

The mandrel 13 includes two main sets of oil ways, one for conveying hydraulic fluid from the umbilical to the module and the second for directing the mandrel's independent oil flushing/recirculating system past the electrical contact bands 22, 23. These will be described in detail in conjunction with FIG. 10 below.

Figure 8:
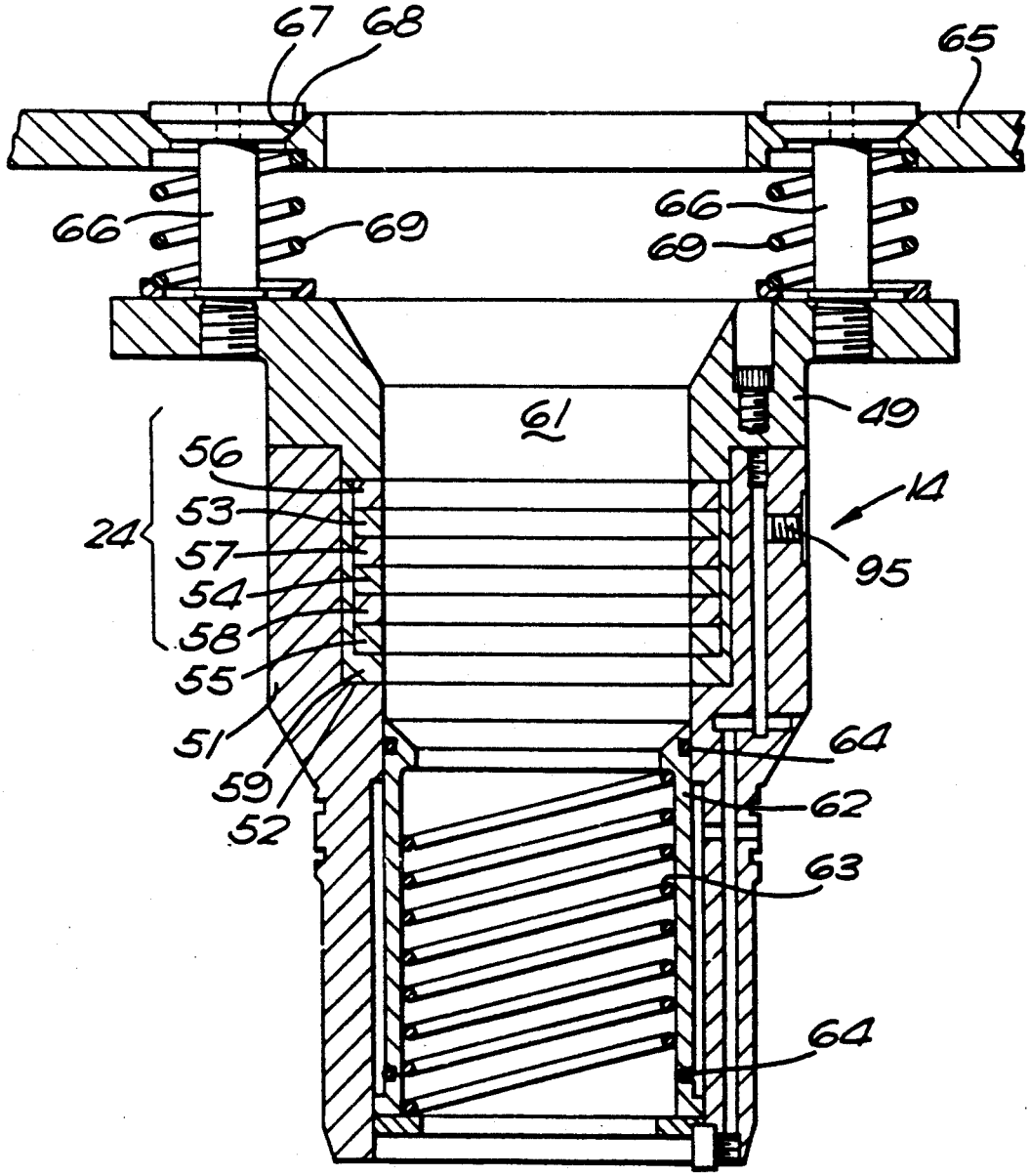
FIG. 8 is an axial cross section through an upper receiver for the coupler of FIG. 7.

FIG. 8 shows the upper receiver 14 in detail. It comprises an upper collar 49 and a body 51. The contact band 24 is located in position between the collar 49 and a shoulder 52 within the body 51. The contact band 24 is located in position between the collar 49 and a shoulder 52 within the body 51. The contact band 24 comprises three conductor rings 53, 54, 55 and three alternating plastics insulator rings 56, 57, 58 all of the rings being located within a flanged tube 59 also made of a plastics insulating material.

The collar 49 and body 51 define a bore 61 which receives the mandrel 13. An upper spring sleeve 62 is located in the bore 61. In FIG. 8, it is shown in its lower or displaced position however, it is normally urged into an upper position by a spring 63, in which it covers the contact band 24 and forms a fluid tight seal by means of elastomeric O-rings 64.

The upper receiver 14 includes oil passageways for conveying fluid to the module and also passageways for the flushing system as will be described with reference to FIG. 10 below.

The collar 49 is suspended from a support plate 65 on the module by means of bolts 66. The bolt heads each have an oblique (45°) under surface 67 urged into engagement with a correspondingly angled seat 68 in the support plate by means of springs 69. Thus, the upper receiver 14 is not rigidly connected to the module.

Figure 9:
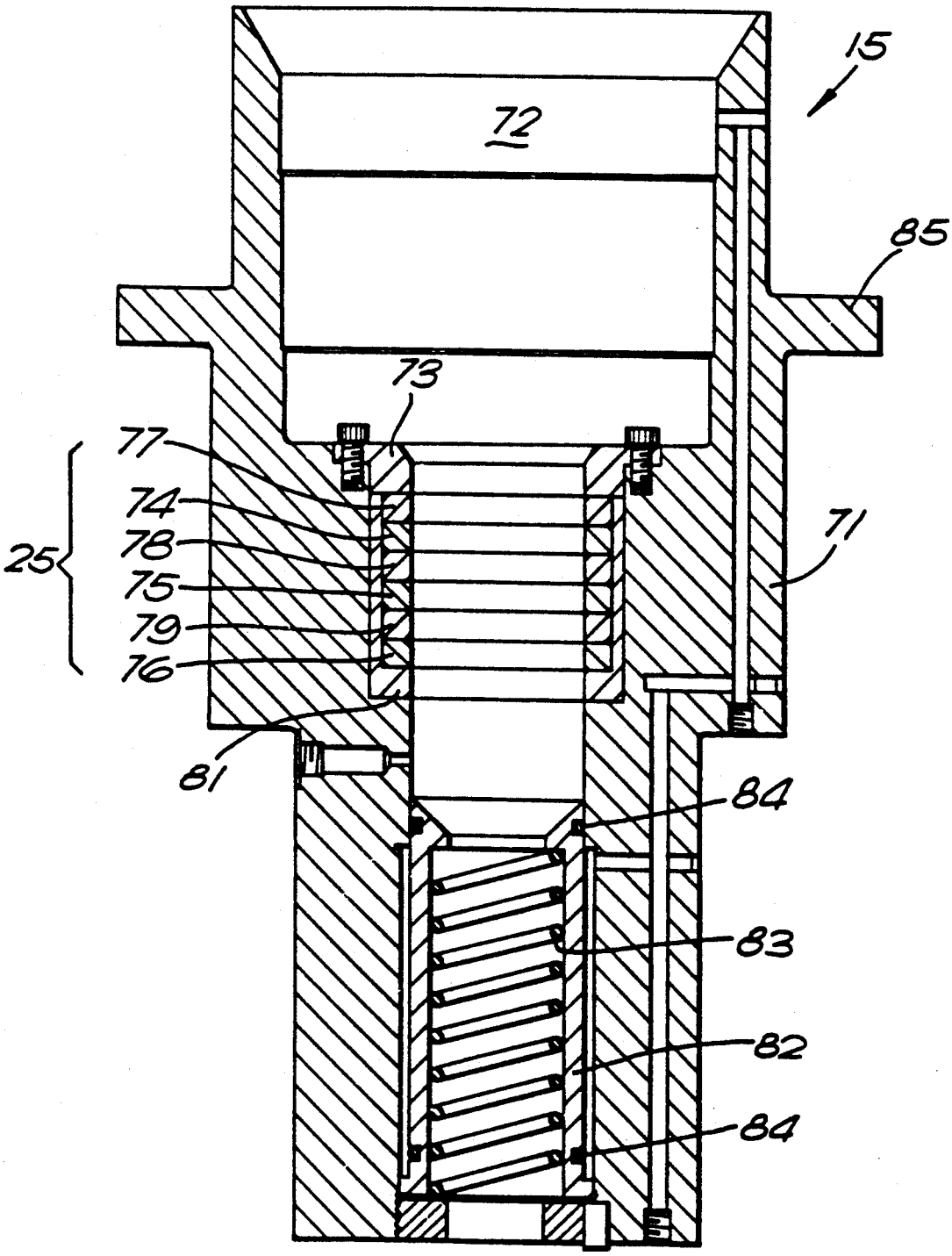
FIG. 9 is an axial cross section through a lower receiver for the coupler of FIG. 7 and the receivers of FIGS. 8 and 9 in the coupled condition.

FIG. 9 shows the lower receiver 15 in detail. It comprises a body 71 defining a bore 72 arranged to receive the mandrel 13. The contact band 25 is located in the bore 72 by means of a locking ring 73, and is of similar construction to the upper contact band 24, comprising three conductor rings 74, 75, 76 three insulator rings 77, 78, 79 and an insulating flanged tube 81.

A lower spring sleeve 82 is located in the bore 72. Its orientation and construction are similar to those in the upper spring sleeve 62, and it functions in the same way with a spring 83 urging the sleeve 82 into a position (not shown) where it covers the contact band 25 with elastomeric O-rings 84 forming a fluid tight seal.

The lower receiver 15 includes oil passageways for conveying fluid to the module and also passageways for the flushing system as will be described with reference to FIG. 10 below. The lower receiver is rigidly connected to the umbilical termination head by means of flanges 85.

Figure 10:
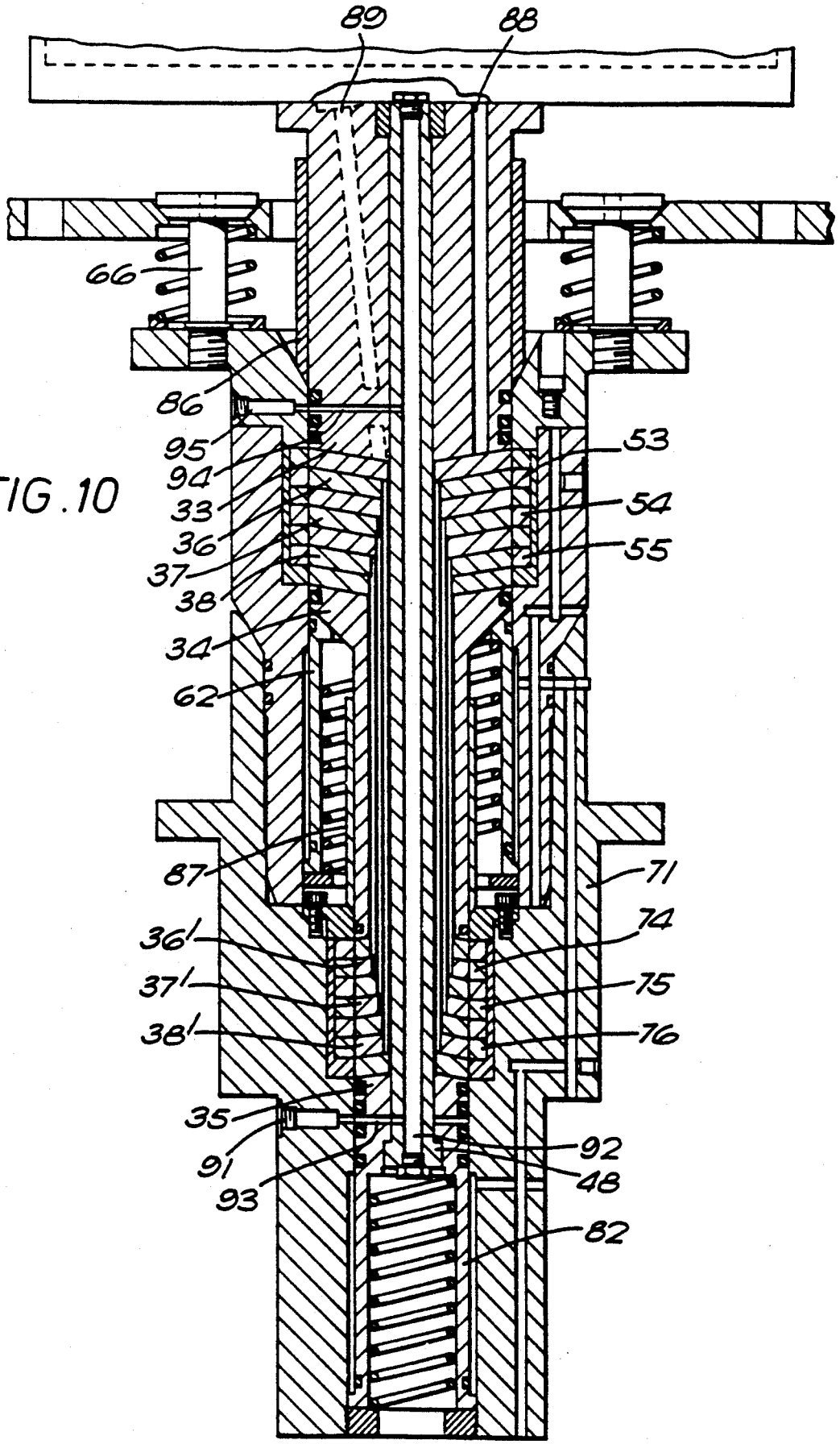
FIG. 10 shows the assembled coupling system in detail.

FIG. 10 shows the assembled coupling system in detail. In practice, the mandrel 13 extends from a housing (not shown) for the oil flushing/circulation system which is itself attached to a handling head (not shown). The handling head is suspended from a running tool (not shown) by means of which the coupling system is transported to is required location and aligned using the guidebase.

When the mandrel 13 is inserted into the two receivers 14, 15 it depresses the spring sleeves 62, 82 to the positions shown while at the same time displacing the upper and lower sleeves 86, 87 from the contact bands 22, 23 on the mandrel 13. The mandrel upper contact rings 36, 37, 38 contact the rings 53, 54, 55 in the upper receiver and the mandrel lower contact rings 36', 37', 38', contact the rings 74, 75, 76 in the lower receiver. Thus, the module and the umbilical are electrically connected for three-phase power supply to the module, but the contact areas can be kept free of water ingress.

The body of the mandrel 13 contains two main sets of oil ways, one for conveying the umbilical supplied hydraulic fluid through to the subsea module, and the second for porting and routing the mandrel's independent oil flushing/circulation system past the contact areas 22, 23.

The first oil system therefore is the oil connection system for supplying the module with oil from the umbilical. For this the lower receiver 15 has a supply oil inlet 91 which connects with a hollow central bore 92 in the rod 48 via a supply oil passage 93 in the lower body 35 of the mandrel 13. The upper body 33 of the mandrel has a similar oil supply passage 94 which connects the bore 92 with a supply oil outlet 95 in the upper receiver 14. Thus, oil/hydraulic fluid can be transferred from the umbilical to the module via the coupling system.

Mounted at the top of the mandrel 13 is the system's integral circulation system 101. It is located in a housing 102 upon which the handling head 103 will be mounted to interface with the running tool 104, as shown in more detail in FIGS. 11 to 16.

Figure 11:
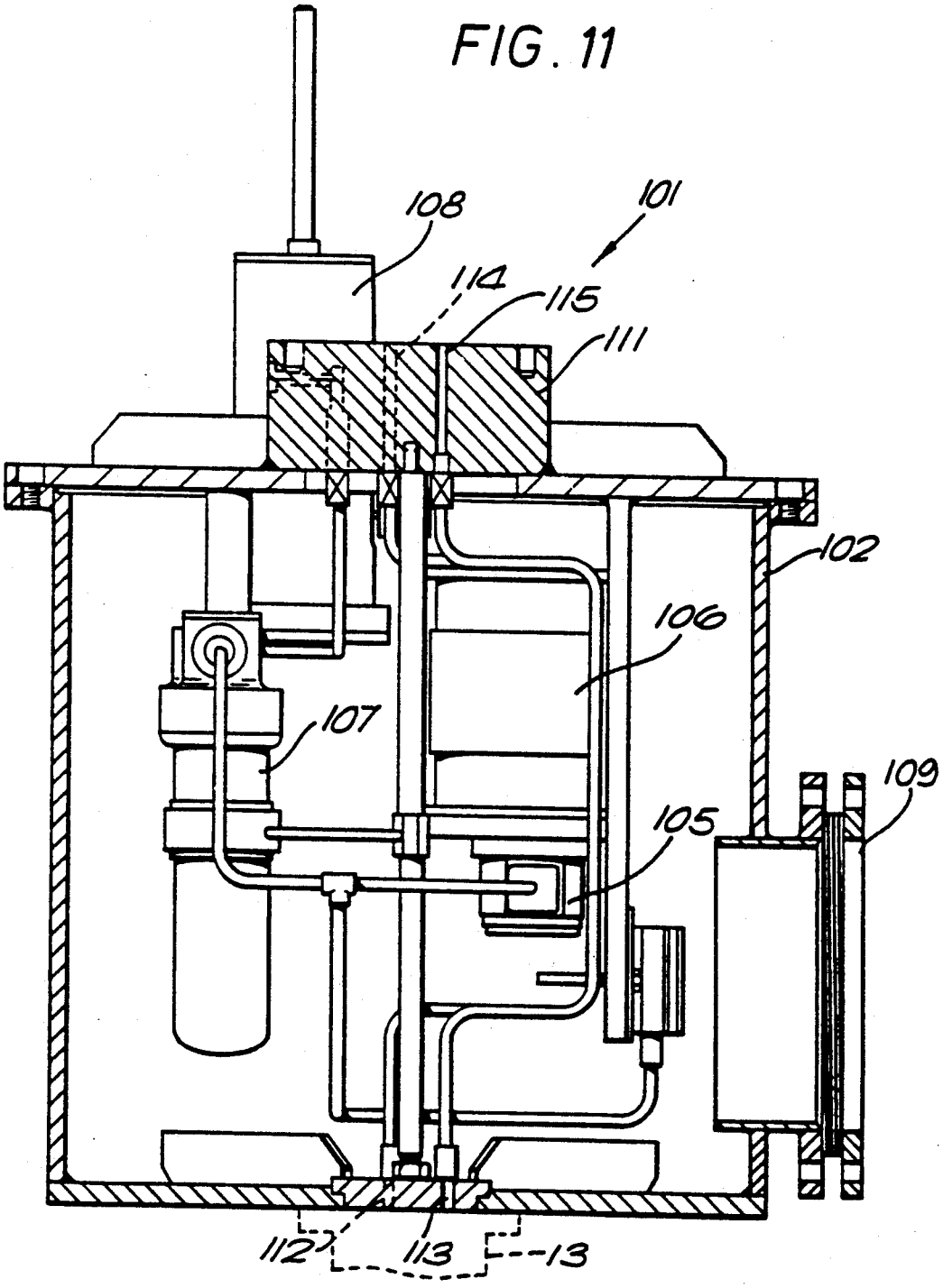
FIG. 11 is a partially cutaway elevation of an oil circulation system for use with the present invention.
Figure 12:
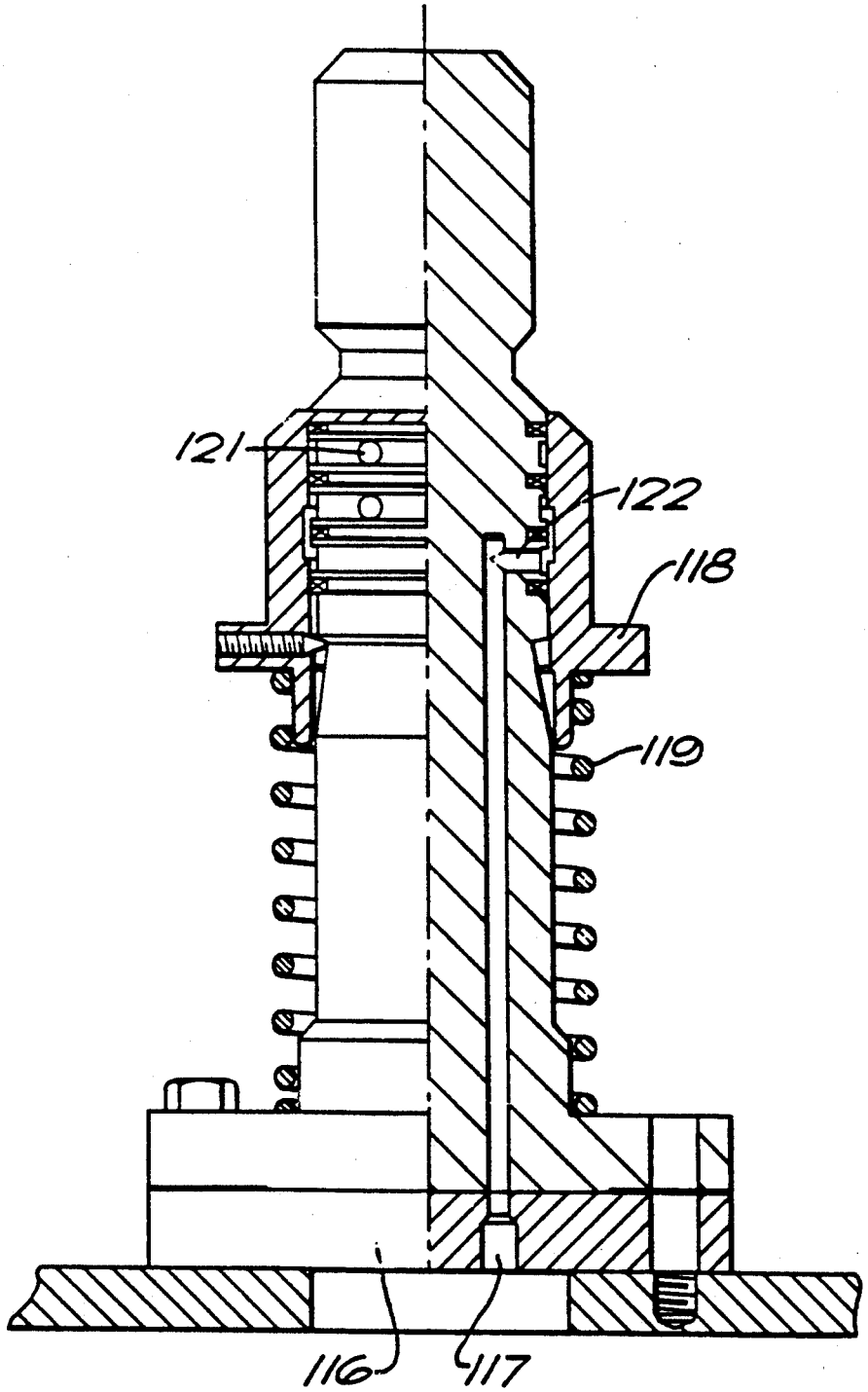
FIG. 12 is an elevation, partially in section, of a handling head for use with the present invention.

The circulation system 101 is primarily included to remove any debris or scaling from the coupler during operation, and to keep an over-pressure in the coupler to avoid seawater intrusion. A secondary effect will be cooling of the contact areas. As shown in FIG. 11, the circulation system is mounted in the housing 102 which constitutes a sealed reservoir 102 and consists of the following main components: an hydraulic pump 105, an electric motor 106, a filter 107, temperature, pressure and oil level indicators (not shown), a balance piston 108 and an inspection hatch 109.

At the top, there is a valve block 111 which connects the circulation system 101 to the handling head 103, which is in turn connected to the running tool 104. At the bottom, the housing 102 is mounted on the top flange of the mandrel 13 where hydraulic lines 112 and 113 connect with an inlet 88 and an outlet 89 to the mandrel 13. The valve block 111 includes hydraulic connections 114 and 115 to corresponding hydraulic openings 116 and 117 in the handling head 103.

The balance piston 108 provides pressure equalisation between the seawater and the oil reservoir to prevent seawater ingress and to make sure that the hydraulic system will always be balanced to the ambient pressure. The hydraulic circulation pump 105 is a gear pump and provides a positive pressure difference between the sea and the CIC contact areas and thus eliminates seawater ingress.

Electric power supply to the circulation system motor 106 is taken from the electric power being transferred through the electric coupler. The electric power lines to the motor 106 are led through a stop switch installed on the balance piston 108. This arrangement will stop the electric motor 106 if the reservoir oil level becomes lower than a pre-set value.

The running tool 104 hydraulic interface is connected to the handling head (or connection hub) 103 mounted on top of the circulation unit, where a spring return sliding sleeve 118, 119 protects the hydraulic openings 121, 122 in the head 103. Thus, hydraulic flushing lines from the running tool 104 flushing system are routed via the handling head 103 through the circulation system supply/return lines which match with the hydraulic connections in the CIC body.

The key functions of the running tool 104 are to transport safely and to install the ISM subsea and to provide as good as water free connection as possible between the ISM and the receivers. As shown in FIG. 13, the running tool 104 comprises a frame 123 which has a pair of guide funnels 124 and a series of lockdown receivers 125. A hydraulic accumulator 126 is located on the frame 123 and is connected to a coupling 127 which receives the top of the handling head 103. The coupling 127 is mounted on a support plate 128 which can be moved vertically relative to the frame 123 by means of hydraulic cylinders 129. Thus, by actuating the cylinders 129, the mandrel 13 can be inserted into or withdrawn from the receivers 14, 15, via the housing 102, the handling head 103, the coupling 127 and the support plate 128.

Thus, the running tool 104 has the ability to be freestanding and supports and protects the CIC during offshore handling and subsea installation. Furthermore, it can be run on a wire or a drillpipe and uses two guideposts for primary alignment. It is controlled from the surface using an umbilical and after landing on the subsea module, it allows the coupler to be lowered into position. By means of shock absorbers (not shown) a soft landing is assured initially and a hydraulic handling connector provides secondary release.

Figure 15:
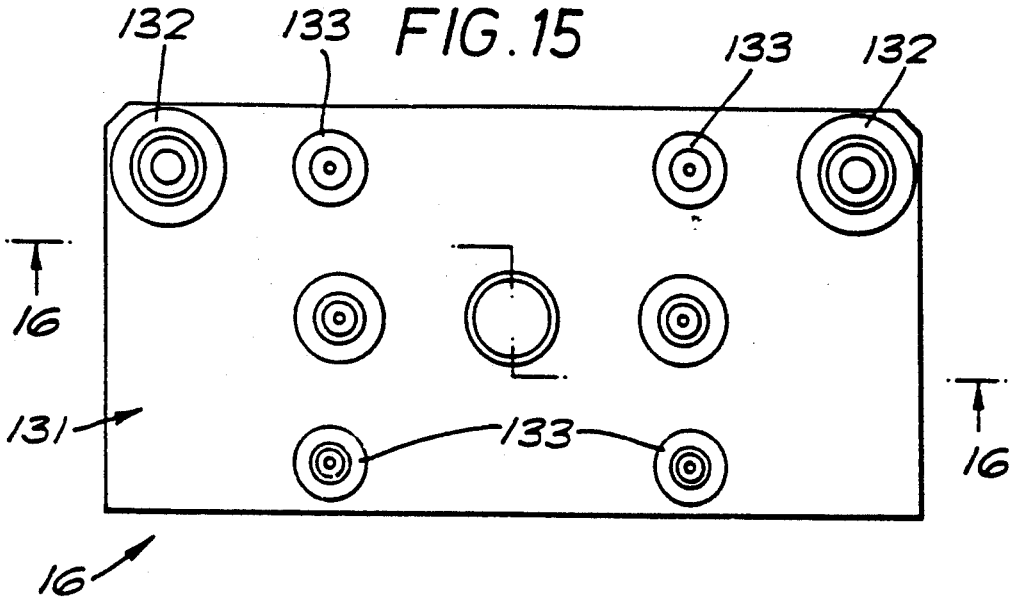
FIG. 15 is a plan view of a guide base.
Figure 16:
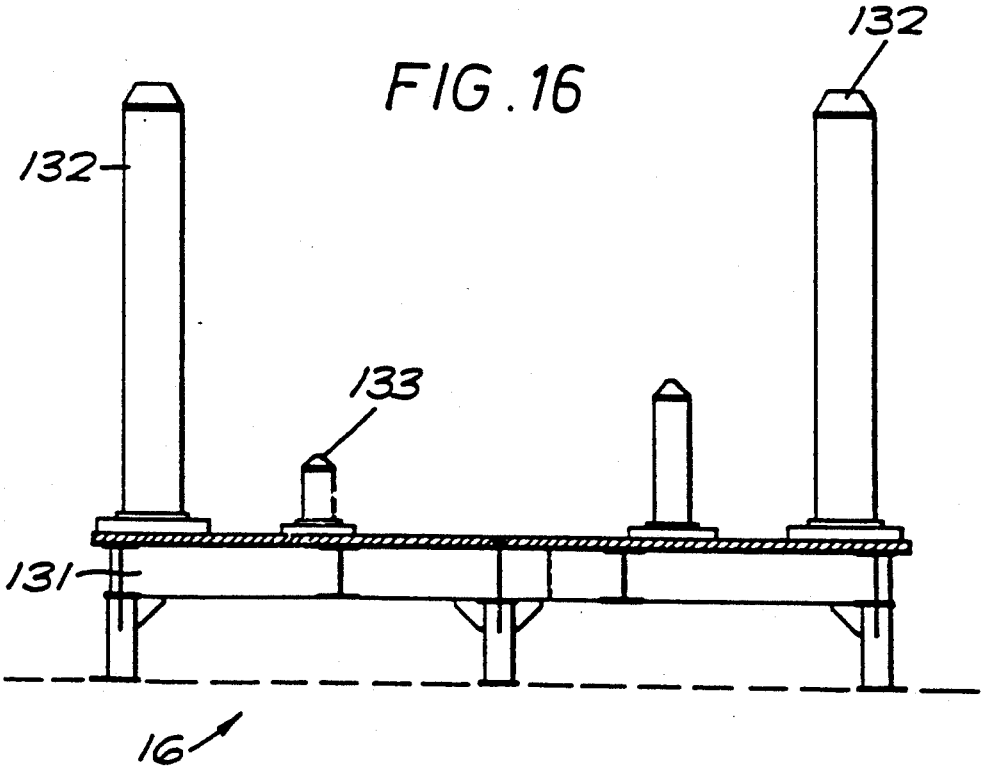
FIG. 16 is a section on the line A—A in FIG. 15.

As shown in FIGS. 15 and 16, the guide base 16 comprises a base frame 131 having a pair of guideposts 132 and a series of guide pins 133. When the running tool 104 is lowered, the guide posts 132 receive the funnels 124 and the running tool 104 is guided to the desired position. The guide pins 133 are received in the lockdown receivers 125.

A typical installation procedure would be as follows:

Make-up umbilical to running tool 104.

Function test running tool 104.

Load conductive insert coupling.

Lock handling head 103.

With subsea module guide wire made up, make up running wire to running tool.

Run subsea and strap umbilical to wire.

Land running tool 104 gently on guide base 16.

Lock down guide pins 133 in lock down receivers 125 as reaction points.

With mandrel 13 in place, open oil flushing accumulator valve and flush out water.

Unlock handling head 103.

Unlock lockdown receivers 125.

Raise running tool 104 off handling head 103, leaving coupler in place.

Retrieve running tool 104 to surface.

To retrieve the coupling, the procedure is reversed with the exception of the flushing of the system.

The operation of the flushing oil system will now be described in more detail.

The flushing oil inlet 88 admits oil from the flushing system housing 102. As the running tool pushes the stab mandrel 13 into position inside the receivers 14, 15 and displaces the system's protective sliding sleeves 62, 82, 86, 87 jets of (accumulator driven) flushing oil are released in the sleeve and contact band area, which displaces the local water and reduces potential water ingress to an absolute minimum. With the insert stab mandrel in place, stage two flushing takes place. This consists of a complete purging of the flushing oilway system in the coupling. Flushing oil is driven by an accumulator on the tool, through the coupling system and back up to a receiver tank on the tool, via flushing oil outlet 89.

After the mandrel 13 has been installed, the running tool injects flushing oil into the lower cavities of each receiver.

The objective of this flushing is to leave a volume of oil which will prevent marine growth.

Before the retrieval of the coupling or mandrel 13, the lower cavities of both receivers 14, 15 are flushed with clean oil. On completion of flushing, the running tool is moved upwards and the protective spring operated sleeves 62, 82 move up behind the mandrel. In doing so, the upper seal 64, 84 in both the sleeves 62, 82 will perform two functions; first it will push the water and wipe the conductive bands 24, 25 and secondly it will suck up a clean film of oil from the cavity below. Therefore, when the mandrel 13 is fully retrieved, the sleeves will be set in position over the conductive bands with a water free film of oil in between.

We claim:

1. An apparatus for electrically coupling together a subsea installation and a subsea module landed on said subsea installation, said apparatus comprising:

a first receiver mounted on said module;

a first electrical terminal set in said first receiver;

a second receiver mounted on said installation;

a second electrical terminal set on said second receiver;

an insert stab mandrel;

a spaced pair of electrical terminal sets on said insert stab mandrel;

means carried by said insert stab mandrel electrically connecting together respective terminals of said spaced pair of electrical terminal sets, said first and second receivers each being adapted to receive said insert stab mandrel therein with each of said spaced pair of electrical terminal sets located in electrical contact with a respective one of said first and second terminal sets, thereby providing electrical connection between said first and second electrical terminal sets, and means for moving said insert stab mandrel into and out of said receivers independently of movement of said subsea installation and said subsea module.

2. The apparatus of claim 1 further comprising a hydraulic fluid outlet at said second receiver, a hydraulic fluid inlet at said first receiver, and a supply hydraulic fluid pathway in said insert stab mandrel interconnecting said fluid outlet and said fluid inlet when said insert stab mandrel is received in said receivers.

3. The apparatus of claim 1 further comprising a signals outlet at said first receiver, a signal inlet at said second receiver, and a signals pathway in said insert stab mandrel interconnecting said signals outlet and said signals inlet when said insert stab mandrel is received in said receivers.

4. The apparatus of claim 1 further comprising at least one slidable sleeve covering one set of said electrical terminal sets, said sleeve being displaced to expose said electrical terminal set when said insert stab mandrel is received in said receivers.

5. The apparatus of claim 4 further comprising biassing means biassing said at least one slidable sleeve against displacement to expose said electrical terminal set.

6. The apparatus of claim 1 further comprising a self contained oil flushing system in said insert stab mandrel, said system adapted to supply flushing oil to said electrical terminal sets upon insertion and withdrawal of said insert stab mandrel.

7. The apparatus of claim 1 wherein said means for moving comprise a running tool and a handling head on said insert stab mandrel whereby said insert stab mandrel can be moved by said running tool.

8. The apparatus of claim 1 wherein said first and second receivers are mounted so that said receivers are substantially aligned, and wherein at least one of said first and second receivers is open-ended for movement of said insert stab mandrel through said at least receiver into the other of said receivers.

9. The apparatus of claim 8 wherein said one of said receivers is located above the other of said receivers.

10. The apparatus of claim 9 wherein said upper receiver is mounted on said module and said lower receiver is mounted on an umbilical termination head of said subsea installation.

11. The apparatus of claim 9 wherein said upper receiver is received within said lower receiver, and wherein said upper receiver is non-rigidly mounted by said mounting means.

12. The apparatus of claim 1 wherein at least one of said first and second receivers is non-rigidly mounted by mounting means.

13. An apparatus for effecting electrical connection between first and second subsea units, said apparatus comprising:

means for establishing a predetermined relationship between said first and second subsea units, a first receiver and a second receiver, said first receiver having axially opposed open ends, first and second mounting means mounting said first and said second receivers in substantial alignment on said first and second subsea units respectively in said predetermined relationship of said first and second subsea units, a mandrel movable through said first receiver into said second receiver to have first and second spaced portions of said mandrel received in said first and second receivers respectively, first and second electrical contact means at said first and second receivers, and electrical conductor means extending between said first and second portions of said mandrel, said electrical conductor means cooperating with said first and second electrical contact means when said mandrel first and second portions are received within said first and second receivers respectively to thereby establish said electrical connection.

14. The apparatus of claim 13 wherein at least one of said mounting means permits limited pivotal movement of said receiver mounted thereby.

15. The apparatus of claim 13 wherein one of said first and second receivers includes a portion thereof adapted to be received in the other of said first and second receivers.

16. A method of electrically connecting together a first subsea unit and a second subsea unit, said method comprising the steps of:

providing on said first and second units means locating said first and second units in a predetermined relative position;

providing on said first and second units respective first and second receivers, each receiver having a respective electrical terminal set;

providing an insert stab mandrel having a pair of spaced electrical terminal sets and means electrically connecting together respective terminals in each of said terminal sets, said insert stab mandrel being receivable in said first and second receivers in said predetermined relative position of said first and second units, and said terminal sets being so located that when said insert stab mandrel is received in said receivers each of said terminal sets of said insert stab mandrel electrically contacts a respective one of said terminal sets of said receivers;

locating said first and second units in said predetermined relative location with said insert stab mandrel absent from said receivers, and moving said inset stab mandrel, with said first and second units in said predetermined relative location, so as to be received in said receivers, to thereby electrically connect together said first and second units.

17. The method of claim 16 wherein said movement of said insert stab mandrel moves slidable sleeves from positions covering said electrical terminal sets of said receivers to expose said terminal sets.

18. The method of claim 17 further comprising flushing oil through flushing oil passageways in said insert stab mandrel over said terminal sets exposed by said movement of said slidable sleeves.

19. The method of claim 18 further comprising completely purging said flushing oil passageways with flushing oil after said insert stab mandrel has been inserted.

20. The method of claim 19 further comprising injecting flushing oil into said receivers after said purging step.

21. The method of claim 16 wherein said insert stab mandrel connects a hydraulic fluid outlet in one of said receivers to a hydraulic fluid inlet in the other of said receivers, through said insert stab mandrel.

22. The method of claim 16 wherein said insert stab mandrel connects a signals outlet in one of said receivers to a signals inlet in the other of said receivers through said insert stab mandrel.

23. An apparatus for electrically coupling together first and second subsea units, said apparatus comprising:

a first receiver mounted on said first unit;

a first electrical terminal set on said second receiver, an insert stab mandrel, said stab mandrel comprising first and second body portions and an intermediate body portion between said first and second body portions, a first set of electrical contact bands located between said first and said intermediate body portions, a second set of electrical contact bands located between said intermediate and said second body portions, and a series of concentric conductors electrically connecting respective bands in said first and second sets, said first and second receivers each being adapted to receive said insert stab mandrel therein with each of said first and second sets of electrical contact bands in electrical contact with a respective one of said first and second electrical terminal sets, thereby providing electrical connection between said first and second subsea units.

24. An apparatus as claimed in claim 23 wherein said mandrel further comprises an axially extending tensioning rod, the components of said mandrel being held in compression by said tensioning rod.

* * * * *